US005984529A

United States Patent [19]

Drigani et al.

[11] Patent Number: 5,984,529

[45] Date of Patent: Nov. 16, 1999

[54] SLIDING BEARINGS FOR CHOCKS IN ROLLING MILL STANDS WITH CROSSED DISPLACEMENT OF THE ROLLS UNDER LOAD

[75] Inventors: Fausto Drigani, Zugliano; Cesare Galletti, Segrate; Giacinto Dal Pan, Cellatica, all of Italy

[73] Assignee: Danieli & C. Officine Meccaniche SpA, Buttrio, Italy

[21] Appl. No.: 08/880,447

[22] Filed: Jun. 23, 1997

[30] Foreign Application Priority Data

Jun. 24, 1996 [IT] Italy ..... UD96A0107

[51] Int. Cl.[6] ..... F16C 19/30

[52] U.S. Cl. ..... 384/619

[58] Field of Search ..... 384/618, 619, 384/620, 590, 593, 597

[56] References Cited

U.S. PATENT DOCUMENTS

| | | | |
|---|---|---|---|
| 609,697 | 8/1898 | Nielson | 384/593 |
| 1,376,309 | 4/1921 | Armstrong . | |
| 1,649,285 | 11/1927 | Buckwalter | 384/618 |
| 3,199,328 | 8/1965 | Toth . | |
| 5,320,434 | 6/1994 | Fijihara et al. | 384/620 |

FOREIGN PATENT DOCUMENTS

| | | |
|---|---|---|
| 59-16264 | 1/1984 | Japan . |
| 59-16265 | 1/1984 | Japan . |
| 1187219 | 4/1970 | United Kingdom . |
| 2141959 | 1/1985 | United Kingdom . |

OTHER PUBLICATIONS

Patent Abstracts of Japan vol. 007 No. 44 (M–195) Feb. 22, 1983 & JP 57 193211 (Mitsubishi) Nov. 27, 1982 abstract.

Patent Abstracts of Japan vol. 018 No. 677 (M–1727) Dec. 20, 1994 & JP 06 269812 (Hitachi) Sep. 27, 1994—abstract.

Patent Abstracts of Japan vol. 16, No. 245 (M–1260) Jun. 4, 1992 & JP 04 055004 (Mitsubishi) Feb. 21, 1992—abstract.

Shunji Kamada et al "Edge Profile Control Using Pair Cross Mill In Cold Rolling" Iron and Steel Engineer, vol. 73, No. 6, Jun. 1, 1996, pp. 20–26, p. 22, Fig. 4.

Research Disclosure No. 293 Sep. 1, 1988 New York, NY USA, p. 658 Disclosed Anonymously "Rolling Mill Stand" –whole document.

*Primary Examiner*—Thomas R. Hannon

*Attorney, Agent, or Firm*—Antonelli, Terry, Stout & Kraus, LLP

[57] ABSTRACT

Sliding bearings for chocks (11) in back-up rolls (12) under load, the back-up rolls (12) cooperating with the respective working rolls (112) and being able to perform crossed displacement in a four-high rolling mill stand for the hot rolling of sheet and/or large plate, the chocks (11) cooperating on the outside with organs to transmit the load from the rolls to the stationary housing (21) and organs to regulate the gap between the working rolls (112), these organs comprising millscrews, hydraulic capsules (13), spacers, etc., the bearings comprising a revolving bearing with conical, truncated cone or barrel-shaped rollers arranged in an intermediate contact position between a lower sliding element, attached to the chock, and an upper sliding element solid with the relative organs to transmit the load, the top or the smaller base of the rollers facing the chock opposite the one with which they are associated, the rollers being disposed radially to define a circular section the center of which is defined by the vertical projection of the center of rotation of the relative back-up roll.

10 Claims, 2 Drawing Sheets

SLIDING BEARINGS FOR CHOCKS IN ROLLING MILL STANDS WITH CROSSED DISPLACEMENT OF THE ROLLS UNDER LOAD

BACKGROUND OF THE INVENTION

This invention concerns sliding bearings for chocks in rolling mill stands with crossed displacement of the rolls under load.

The sliding bearings are applied in cooperation with the chocks of the four-high rolling mill stands to produce hot rolled sheet and/or large plate which include the crossed displacement of the rolls also during the hot rolling cycle.

The state of the art covers four-high rolling mill stands which comprise two opposed working rolls associated with relative back-up rolls with the function of limiting the bending of the working rolls during the rolling step.

Moreover the state of the art also covers rolling techniques which include the reciprocal pair crossing of both pairs of rolls or at least the crossed displacement of the working rolls alone.

These techniques make it possible to control more accurately the profile of the rolled product and therefore more generally to obtain products of a higher quality.

At the present time the pair crossing movements are carried out during the resting stage between the rolling of two successive slabs; this is necessary because of the considerable thrust forces transmitted by the rolls during the passage of the rolled product which make this displacement practically impossible during the rolling step.

These thrust forces generate friction between the chocks of the upper and lower back-up rolls and the respective organs, such as millscrews, hydraulic actuator capsules, spacers, etc., which discharge the rolling force onto the housing of the rolling mill stand.

This friction contrasts the pair crossing movement.

The introduction of continuous rolling of sheet or large plate, with welding of the ends of the individual slabs, has highlighted this problem of the pair crossing of rolls, which in this case must necessarily take place also during the processing step.

To carry out pair crossing in rolling mill stands such as those known to the state of the art is in fact extremely difficult and inaccurate because of the above-mentioned friction which contrasts the crossing movements; this causes disfunctions and/or damage in the rolling assembly, it causes products of an inferior quality to be obtained, wear in the components which are in reciprocal contact, high powers in play and a whole series of other disadvantages.

Various solutions have therefore been proposed to solve the problem of moving the rolls under load with respect to the relative chocks, but these solutions have not been able to solve the problem efficiently.

JP 57-193211 teaches to use sliding bearings suitable to reduce the friction between the supporting chocks of the back-up rolls and the corresponding equalizer beams on which the adjustment means of the stand act.

The equalizer beams make the structure of the stand heavy, and also make the conventional operations of adjusting the rolls and transmitting the rolling load less precise.

The sliding bearings consist of a series of cylindrical rollers arranged parallel to each other and separated in such a manner as to cover substantially the entire width of the relative chock.

This parallel arrangement of the cylindrical rollers, and their cylindrical shape itself, causes a high level of rubbing on the horizontal plane, both between the cylindrical rollers and the chock and also between the cylindrical rollers and the stationary housing; on the one hand this makes the pair crossing adjustment very imprecise and on the other hand it requires high forces of thrust to be used. Moreover the cylindrical rollers are subjected to anomalous stress, with localised and disuniform overloads.

GB-A-2141959 describes friction-reducing means interposed between the chock and the housing and not between the chock and the means to adjust the rolls.

The friction-reducing means can include, in the various solutions proposed, limiting plates inside which a fluid is made to circulate, a series of cylindrical rollers arranged parallel to each other on the width of the relative chock and a series of pads made of high resistance elastic material, for example rubber or similar.

In the first case, the plates to limit the fluid cause problems if the rolling stand includes systems to adjust the rolls and to transmit the load placed between the housing and the chock.

Moreover, they create problems of sliding friction and therefore of wear caused by rubbing between the parts in reciprocal movement.

The system with parallel cylindrical rollers has the same problems as those mentioned above with regard to JP'211, while the system with elastic pads does not guarantee a sufficient reduction in the friction, given the extremely high forces of thrust which act between the housing and the chock when the rolls are under load.

JP 06-269812 does not refer to a four-high stand and includes friction-reducing means between the supporting chock of the working rolls and the stationary housing. These means consist of two plates arranged in contact with each other defining small chambers into which fluid under pressure is fed.

The surface of the parts in contact is very large, and this causes a minimum reduction of the friction, and premature wear; moreover, a great force of thrust is required due to the sliding friction which develops between the two parts in reciprocal movement.

The Research Disclosure n°. 293, September 1988, simply describes the introduction of lubricating fluid into pads located between the hydraulic capsules and the relative chocks, but this solution does not solve any of the above-mentioned problems.

JP 04-55004 describes the use of cylindrical bearings consisting of a plurality of small rollers of very reduced diameter arranged radially with their axis lying on the radius of the circumference where the centre is the point of rotation of the chock.

This solution, although it improves on the solution with the cylindrical rollers arranged parallel, does not completely solve the problems which derive from using small cylindrical rollers which in any case cause horizontal rubbing of the parts in reciprocal movement precisely because of the cylindrical shape of the friction-reducing rollers.

Moreover, this solution involves complex construction, assembly and adjustment, and also keeps wide areas without rollers, with a high concentration of loads, which concentration is accentuated by the small size of the rollers themselves.

Moreover, this document also proposes using an equalizer plate placed between the chock and the housing.

For this reason, it does not solve the problems of decreased accuracy of the crossover movements, the need to use extremely high displacement forces, and the premature wear of the parts in reciprocal contact.

SUMMARY OF THE INVENTION

The present applicants have designed, tested and embodied this invention in order to overcome the shortcomings of the state of the art and to achieve a better solution than those already known in terms of accuracy in positioning, wear of the parts in reciprocal movement, and displacement force required.

The purpose of the invention is to provide sliding bearings to apply in cooperation with the chocks of rolls in four-high rolling mill stands for hot rolled strip or sheet which will make it possible to carry out the crossed displacement of the rolls during the rolling step, thus considerably reducing, or making substantially ineffective, the forces of friction which contrast this pair crossing movement.

To be more exact, the invention substantially annuls any rubbing on the horizontal plane between the parts in reciprocal movement, and eliminates any component of sliding friction, thus minimizing wear and the amount of displacement force required, and ensuring maximum accuracy of the crossover movements of the rolls.

The invention is substantially composed of an anti-friction element located between the respective organs to adjust the gap and to transmit load to the rolls (millscrews, capsules, spacers, etc.) and the outer face of the chock of the back-up roll to be displaced and in correspondence with which chock these organs act.

According to a first embodiment of the invention, the anti-friction element is composed of a hydrostatic bearing inside which, before the crossing angle is varied, a desired value of pressure of the circulating liquid is obtained.

The hydrostatic bearing comprises a plurality of hydrostatic chambers or pockets defining a clearance between the organs to regulate the gap and the outer face of the relative chock, the chambers or pockets being suitable to be filled with fluid at the desired pressure during the crossing of the rolls under load.

Thanks to these hydrostatic chambers or pockets defining a clearance between the moving parts, which clearance is filled with fluid, there is no contact between the moving parts and therefore no rubbing. In this way it is possible to avoid problems of premature wear, reduced accuracy of adjustment as time passes, the need for maintenance and the need to increase the force required by the organs which perform the crossing of the rolls.

During those processing steps when the rolls maintain a stable pair crossing position, the pressure of the liquid remains substantially nil, and the load is transmitted ordinarily onto the relative chocks.

During those steps when the reciprocal crossed position of the rolls is varied, before carrying out the displacement, the pressure of the liquid is increased, thus creating in fact a sliding fluid layer without contact between the chock and the relative organs to regulate the gap and transmit the load; this sliding fluid layer enables the rolls to be displaced in a condition of minimum friction, minimum wear on the parts and minimum displacement force required.

The pressure of the liquid is regulated and controlled by a control unit which monitors and elaborates a series of parameters relating to the processing conditions, and sends commands to the unit which regulates the hydrostatic bearing.

This control unit acts on the mechanical adjustment means to which it transmits any necessary commands to compensate the laminating load in the event that the laminating load is influenced by the action of the liquid of the hydrostatic bearing on the chock.

According to another embodiment of the invention, the anti-friction element which achieves the sliding bearings according to the invention is composed of at least a circular sector of a conical or truncated cone roller bearing located between the organs to transmit the load and to regulate the gap between the rolls and the relative outer face of the chock on which the organs act.

According to a variant, the rollers are barrel-shaped, and their curvature is a function of the load which is applied and of the elastic property of the rollers themselves.

According to the invention the rollers of the bearing are located radially in such a way that the extensions of their axes of rotation intersect on a vertical axis passing through the mean point of the rolls which are to be displaced.

The conical or truncated cone rollers according to the invention have their top part, or smaller base, facing the chock which is opposite the one with which they are associated.

The radial arrangement of the rollers and their conical shape minimises and even annuls the rubbing component, and therefore the sliding friction, on the horizontal plane of the chocks as they are crossed over under load.

Since rubbing is annulled, a plurality of advantages are achieved in terms of reduced wear, maximum accuracy in displacement, minimum force of displacement required, stability in time and other advantages.

According to a variant of this embodiment, there are a plurality of pads with circulating small cylindrical rollers, the pads being substantially conical in conformation, being located radially in a sector and having the extensions of their relative axes intersecting substantially in correspondence with a vertical axis passing through the mean point of the rolls.

According to a further variant, the anti-friction sliding means are composed of barrel rollers arranged in a sector.

In all the embodiments of the invention, therefore, the displacement of the rolls takes place in conditions of substantially no friction or horizontal rubbing between the chocks of the rolls and the relative hydraulic compression and adjustment capsules, thus allowing the manoeuvre to be carried out more quickly and more accurately and considerably reducing the wear between the contact surfaces of the moving parts.

As the conditions in which the rolls are displaced are better, so it is possible to control the profile of the rolled product better, and therefore to obtain products of optimum quality, exploiting moreover the advantages given by the continuous rolling.

BRIEF DESCRIPTION OF THE DRAWINGS

The attached figures are given as a non-restrictive example and show two preferred embodiments of the invention as follows.

DETAILED DESCRIPTION OF THE PREFERRED EMBODIMENTS

Figures 1, 2:
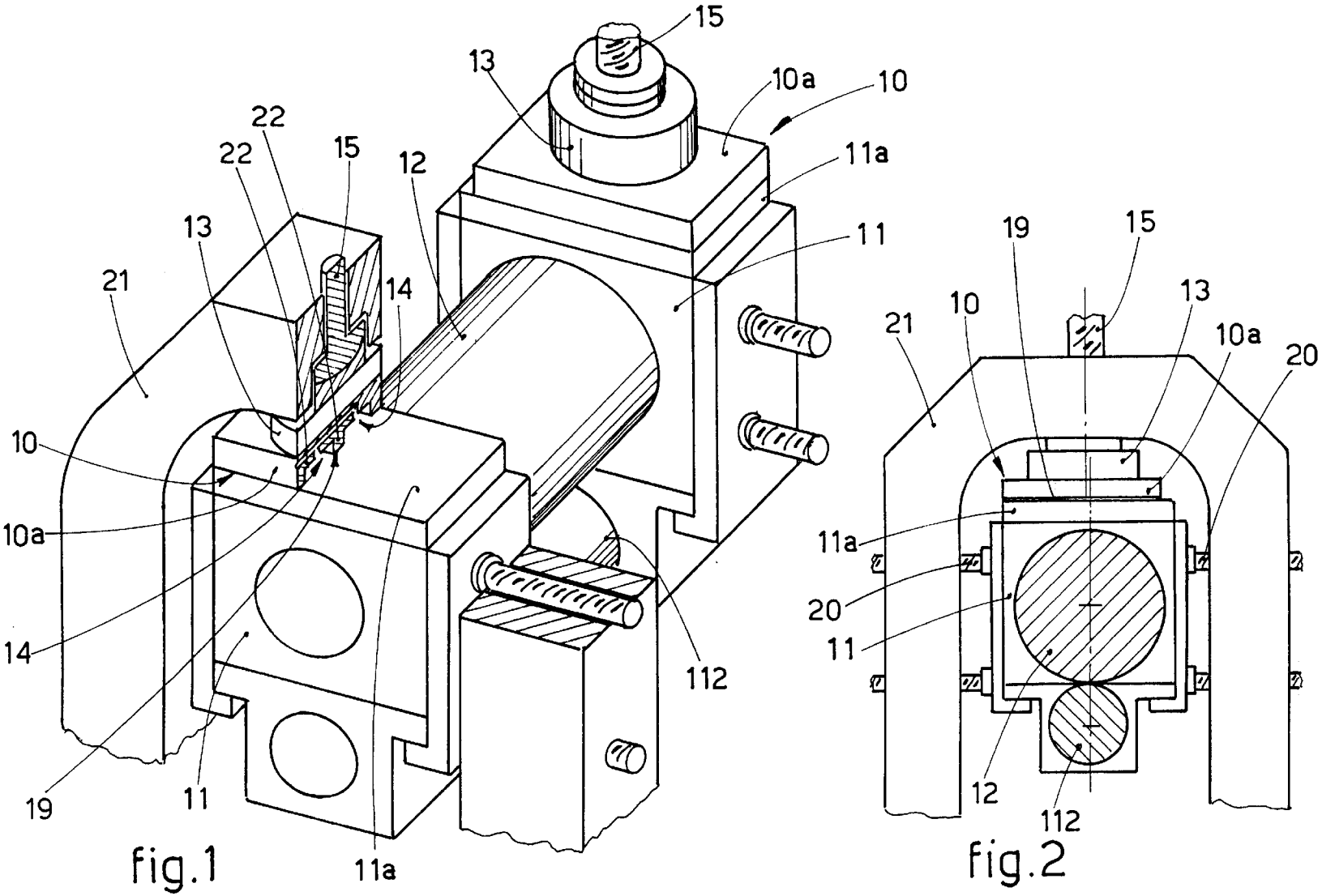
FIG. 1 is a three-dimensional part section view of the sliding bearings according to a first embodiment of the invention.
FIG. 2 is a part transverse section of the rolling mill stand shown in FIG. 1.

The number 10 in the attached figures denotes generally the sliding bearings according to the invention for the chocks 11 of back-up rolls 12 in four-high rolling mill stands which include the crossed displacement of at least one pair of rolls respectively back-up rolls 12 and working rolls 112.

In this case, the bearings 10 are located in an intermediate position between a thin distribution plate 11*a*, whose only purpose is to distribute the load over the whole width of the relative chock 11, solid at the upper part with both the chocks 11 of the back-up roll 12 which is to be displaced, and the relative hydraulic compression capsules 13 which act on the chocks.

This crossing movement is obtained by activating adjustment means, referenced by the number 20, associated with the outer side faces of the chocks 11 and solid with the stationary housing 21.

In the case of FIGS. 1 and 2, the sliding bearings 10 are composed of a hydrostatic bearing 10*a* solid with the hydraulic capsule 13, comprising one or more open chambers or hydrostatic pockets 14 on the upper surface of the distribution plate 11*a* into which the pressure liquid is introduced.

The hydrostatic chambers or pockets 14 are defined by limiting walls 22.

The hydrostatic chambers or pockets 14 and the limiting walls 22 define a clearance 19 which is thinner than the upper face of the relative chock 11, or in this case of the distribution plate 11*a*.

When a condition prevails whereby the rolling rolls 12, 112 are maintained in a stable crossover position, the pressure of the liquid inside the bearing 10*a* is maintained substantially nil, and the load is transmitted by the hydraulic capsule 13 by means of a direct contact between the hydrostatic bearing 10*a* and the distribution plate 11*a*.

Before the crossed displacement of the rolling rolls 12,112, the pressure of the liquid inside the hydrostatic bearing 10*a* is increased, thus creating, in correspondence with the open chambers or hydrostatic pockets 14, a layer of liquid between the upper surface of the distribution plate 11*a* and the lower surface of the hydrostatic bearing 10*a*, the layer of fluid completely filling the clearance 19.

This fluid diaphragm enables the rolling rolls 12, 112 to be displaced in conditions of substantially no friction between the chock 11 and the hydraulic capsule 13, and particularly without any contact, and therefore without any sliding friction and without any rubbing, between the parts in reciprocal movement, and in any case the transmission of the rolling load by the hydraulic capsule 13 is guaranteed.

To be more precise, the chock 11 is displaced solidly with the distribution plate 11*a* in such a way as to make the upper surface of the distribution plate 11*a* slide with respect to the lower surface of the hydrostatic bearing 10*a*, as there is the above-mentioned fluid diaphragm between the two surfaces which fills the clearance 19.

The pressure of the liquid in the hydrostatic bearing 10*a* is controlled by a control unit which, by monitoring the parameters relating to the processing conditions and the displacements of the rolls 12, 112 which are to be carried out, maintains the pressure or varies it in accordance with the appropriate desired values according to the rolling step, in such a way as to maintain substantially constant the pressure load exerted on the product passing through.

The control unit moreover is connected to the mechanical adjustment means 15 on which it may act according to any possible changes in the load conditions determined by a variation in the pressure of the liquid in the hydrostatic bearing 10*a*.

Figure 4:
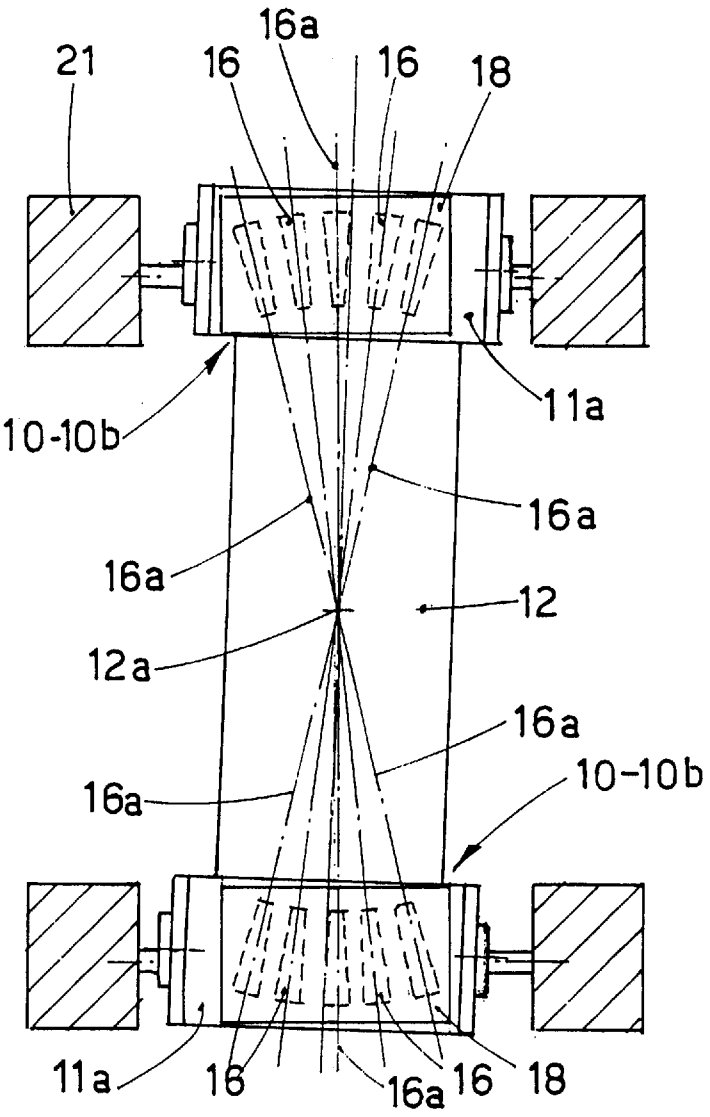
FIG. 4 is a diagram of a view from above the rolling mill stand shown in FIG. 3 and FIGS. 5 and 6 are enlarged views of a portion of FIGS. 4 and 5, respectively, showing another variant of the bearings.
Figure 3:
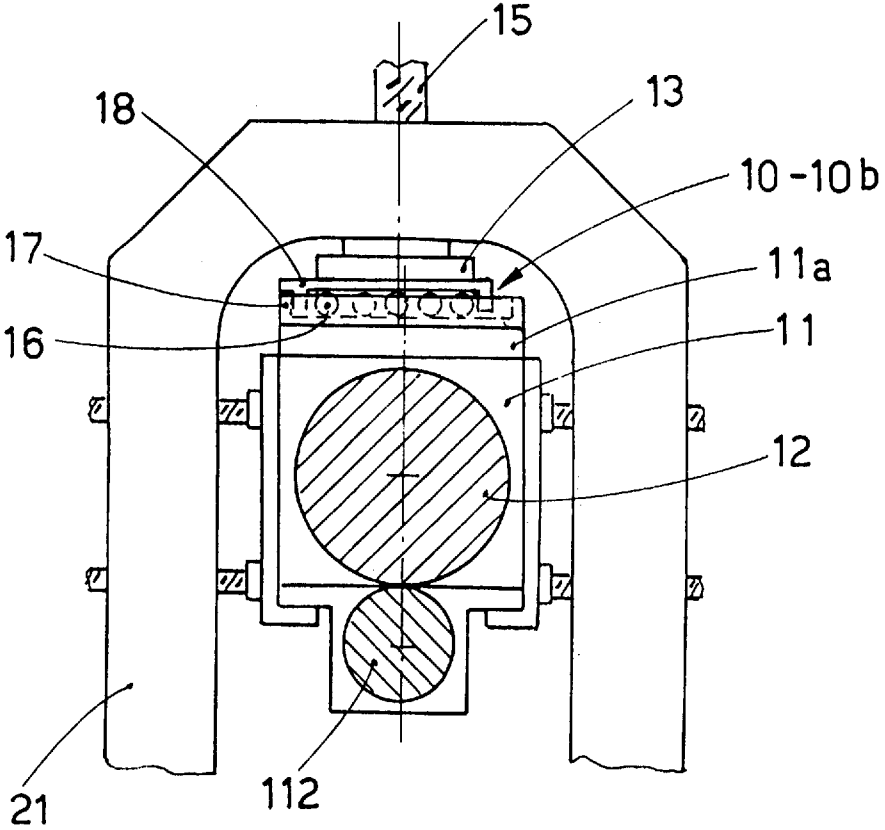
FIG. 3 is a part transverse section of a variant of the bearings according to the invention.

According to another variant of the invention shown in FIGS. 3 and 4, the sliding bearings 10 are substantially composed of a revolving bearing 10*b* with conical or truncated cone rollers 16, which have the relative top, or smaller base, facing the chock 11 opposite the one with which they are associated.

The revolving bearing 10*b* comprises a lower sliding element 17 solid with the distribution plate 11*a* and an upper sliding element 18 solid with the hydraulic capsule 13.

In an intermediate position of contact between the sliding elements 17, 18 the conical or truncated cone rollers 16 are arranged radially.

According to the invention the extensions of the axes of rotation 16*a* of the conical or truncated cone rollers 16 intersect substantially on the vertical of the mean point 12*a* of the roll 12 which is to be displaced, corresponding with the centre of rotation of the roll 12 during the pair crossing step.

During the step when the position of the rolling rolls 12, 112 is maintained, the sliding elements 17, 18 maintain a stable reciprocal position and the work load is transmitted from the hydraulic capsule 13 to the chock 11 through the conical rollers 16.

During the crossed displacement of the rolling rolls 12, 112, the lower sliding element 17 moves, solidly with the distribution plate 11*a* to which it is attached and solid with the relative chock 11, in relation to the upper sliding element 18 sliding on the conical or truncated cone rollers 16.

The displacement therefore takes place in conditions of substantially no friction, while the transmission of the work load is in any case guaranteed by the permanent contact of the conical rollers 16 on the sliding elements 17, 18.

The conical or truncated cone shape of the rollers 16 ensures the absence of rubbing on the horizontal plane of the chock 11 and therefore the component of sliding friction, which derives from the rubbing, is completely annulled.

According to a variant which is not shown here, there are several series of conical or truncated cone rollers 16 arranged radially so as to cover the width of the relative chock 11, each of the series comprising two, three or more rollers 16 arranged in a line along a radius of the circumference which has the point of radiation 12*a* as its centre.

According to a further variant which is shown FIGS. 5 and 6, the rollers 16 are barrel-shaped.

We claim:

1. Sliding bearings for the chocks of back-up rolls under load, the back-up rolls cooperating with respective working rolls and being able to perform crossed displacement in a four-high rolling mill stand for the hot rolling of sheet and/or large plate, the chocks cooperating on the outside with organs to transmit the load from the rolls to the stationary housing and organs to regulate the gap between the working rolls, the bearings being characterised in that they comprise a revolving bearing with conical, truncated cone or barrel shaped rollers arranged in an intermediate contact position between a lower sliding element, attached to the chock, and an upper sliding element solid with the relative organs to transmit the load, the top or the smaller base of the rollers facing the chock (11) opposite the one with which they are associated, the rollers being disposed radially to define a circular sector the center of which is defined by the vertical projection of the center of rotation of the relative back-up roll.

2. Bearings as in claim 1, which comprise cone-shaped pads with circulating rollers disposed radially in a sector and having the extensions of their axes intersecting in correspondence with a vertical axis passing through the mean point of the mating rolling rolls.

3. Bearings as in claim 1, which comprise barrel-shaped rollers disposed radially in a sector and having the extensions of their axes intersecting in correspondence with a vertical axis passing through the mean point of the mating rolling rolls.

4. Bearings as in claim 1, which are associated with a distribution plate solid with the chock placed between the bearings and the chock, substantially for the entire width of the said chock.

5. Bearings as in claim 1, which comprise conical or truncated cone rollers disposed radially in a sector and having the extensions of their axes intersecting in correspondence with a vertical axis passing through the mean point of the mating rolling rolls.

6. A four-high rolling mill stand for the hot rolling of sheet and/or large plate, comprising a stationary housing, a pair of working rolls, a pair of back-up rolls, each cooperating respectively with one of the pair of working rolls, chocks supporting the back-up rolls, cooperating on the outside with organs to transmit the load from the rolls to the stationary housing and organs to regulate the gap between the working rolls and bearings provided between the chocks and the organs to transit the load, the bearings being characterised in that they comprise a revolving bearing with conical, truncated cone or barrel-shaped rollers arranged in an intermediate contact position between a lower sliding element, attached to the chock, and an upper sliding element solid with the relative organs to transmit the load, the top or the smaller base of the rollers facing the chock opposite the one with which they are associated, the rollers being disposed radially to define a circular section the center of which is defined by the vertical projection of the center of rotation of the relative back-up roll.

7. A four-high rolling mill stand as in claim 6, wherein the bearings comprise cone-shaped pads with circulating rollers disposed radially in a sector and having the extensions of their axes intersecting in correspondence with a vertical axis passing through the mean point of the mating rolling rolls.

8. A four-high rolling mill stand as in claim 6, wherein the bearings comprise barrel-shaped rollers disposed radially in a sector and having the extensions of their axes intersecting in correspondence with a vertical axis passing through the mean point of the mating rolling rolls.

9. A four-high rolling mill stand as in claim 6, wherein the bearings are associated with a distribution plate solid with the chock placed between the bearings and the chock, substantially for the entire width of the said chock.

10. A four-high rolling mill stand as in claim 6, wherein the bearings comprise conical or truncated cone rollers disposed radially in a sector and having the extensions of their axes intersecting in correspondence with a vertical axis passing through the mean point of the mating rolling rolls.

* * * * *